US006427638B1

(12) United States Patent
Kolbusz et al.

(10) Patent No.: US 6,427,638 B1
(45) Date of Patent: Aug. 6, 2002

(54) WATER HEATER APPARATUS

(76) Inventors: Chris Kolbusz, 39 Wooldand Ave., Stratford, CT (US) 06614; Patrick Mc Gill, 11 Union St., Seymour, CT (US) 06483

( * ) Notice: Subject to any disclaimer, the term of this patent is extended or adjusted under 35 U.S.C. 154(b) by 0 days.

(21) Appl. No.: 09/802,552

(22) Filed: Mar. 9, 2001

(51) Int. Cl.[7] ..... F22B 5/04
(52) U.S. Cl. ..... 122/15.1; 122/31.1
(58) Field of Search ..... 122/15.1, 18.1, 122/19.1, 31.1, 31.2, 30; 392/461

(56) References Cited

U.S. PATENT DOCUMENTS 4,393,815 A * 7/1983 Pedersen et al. ..... 122/31.1
4,408,567 A * 10/1983 Morton ..... 122/15.1
4,732,590 A * 3/1988 McNeil ..... 122/15.1
5,228,413 A * 7/1993 Tam ..... 122/15.1
5,337,728 A * 8/1994 Maruyama ..... 122/18.1
5,765,546 A * 6/1998 Mandeville et al. ..... 122/31.1

* cited by examiner

*Primary Examiner*—Gregory Wilson

(57) ABSTRACT

A water heater apparatus for providing energy efficient hot water. The water heater apparatus includes a tank having top, bottom, and side walls, and also having an upper portion and a lower portion, and further having a plurality of heat transferring chambers and ducts being disposed inside thereof; and also includes a plurality of pipes being disposed in the tank; and further includes a heat circulating assembly being connected to the tank for circulating water through the chambers; and also includes a heating assembly being connected to the tank for heating water inside the tank.

16 Claims, 2 Drawing Sheets

WATER HEATER APPARATUS

BACKGROUND OF THE INVENTION

1. Field of the Invention

The present invention relates to a water heater and more particularly pertains to a new water heater apparatus for providing energy efficient hot water.

2. Description of the Prior Art

The use of a water heater is known in the prior art. More specifically, a water heater heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,412,652; U.S. Pat. No. 2,833,267; U.S. Pat. No. 3,254,839; U.S. Pat. No. 5,039,007; U.S. Pat. No. 4,848,655; U.S. Pat. No. 4,122,801; and U.S. Pat. No. Des. 326,712.

While these devices fulfill their respective, particular objectives and requirements, the aforementioned patents do not disclose a new water heater apparatus. The inventive device includes a tank having top, bottom, and side walls, and also having an upper portion and a lower portion, and further having a plurality of heat transferring chambers and ducts being disposed inside thereof; and also includes a plurality of pipes being disposed in the tank; and further includes a heat circulating assembly being connected to the tank for circulating water through the chambers; and also includes a heating assembly being connected to the tank for heating water inside the tank.

In these respects, the water heater apparatus according to the present invention substantially departs from the conventional concepts and designs of the prior art, and in so doing provides an apparatus primarily developed for the purpose of providing energy efficient hot water.

SUMMARY OF THE INVENTION

In view of the foregoing disadvantages inherent in the known types of water heater now present in the prior art, the present invention provides a new water heater apparatus construction wherein the same can be utilized for providing energy efficient hot water.

The general purpose of the present invention, which will be described subsequently in greater detail, is to provide a new water heater apparatus which has many of the advantages of the water heater mentioned heretofore and many novel features that result in a new water heater apparatus which is not anticipated, rendered obvious, suggested, or even implied by any of the prior art water heater, either alone or in any combination thereof.

To attain this, the present invention generally comprises a tank having top, bottom, and side walls, and also having an upper portion and a lower portion, and further having a plurality of heat transferring chambers and ducts being disposed inside thereof; and also includes a plurality of pipes being disposed in the tank; and further includes a heat circulating assembly being connected to the tank for circulating water through the chambers; and also includes a heating assembly being connected to the tank for heating water inside the tank.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water heater apparatus which has many of the advantages of the water heater mentioned heretofore and many novel features that result in a new water heater apparatus which is not anticipated, rendered obvious, suggested, or even implied by any of the prior art water heater, either alone or in any combination thereof.

It is another object of the present invention to provide a new water heater apparatus which may be easily and efficiently manufactured and marketed.

It is a further object of the present invention to provide a new water heater apparatus which is of a durable and reliable construction.

An even further object of the present invention is to provide a new water heater apparatus which is susceptible of a low cost of manufacture with regard to both materials and labor, and which accordingly is then susceptible of low prices of sale to the consuming public, thereby making such water heater apparatus economically available to the buying public.

Still yet another object of the present invention is to provide a new water heater apparatus which provides in the apparatuses and methods of the prior art some of the advantages thereof, while simultaneously overcoming some of the disadvantages normally associated therewith.

Still another object of the present invention is to provide a new water heater apparatus for providing energy efficient hot water.

Yet another object of the present invention is to provide a new water heater apparatus which includes a tank having top, bottom, and side walls, and also having an upper portion and a lower portion, and further having a plurality of heat transferring chambers and ducts being disposed inside thereof; and also includes a plurality of pipes being disposed in the tank; and further includes a heat circulating assembly being connected to the tank for circulating water through the chambers; and also includes a heating assembly being connected to the tank for heating water inside the tank.

Still yet another object of the present invention is to provide a new water heater apparatus that is efficiently designed to reduce gas and oil consumption.

Even still another object of the present invention is to provide a new water heater apparatus that minimizes the amount of time needed to maintain a building structure at a given temperature.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
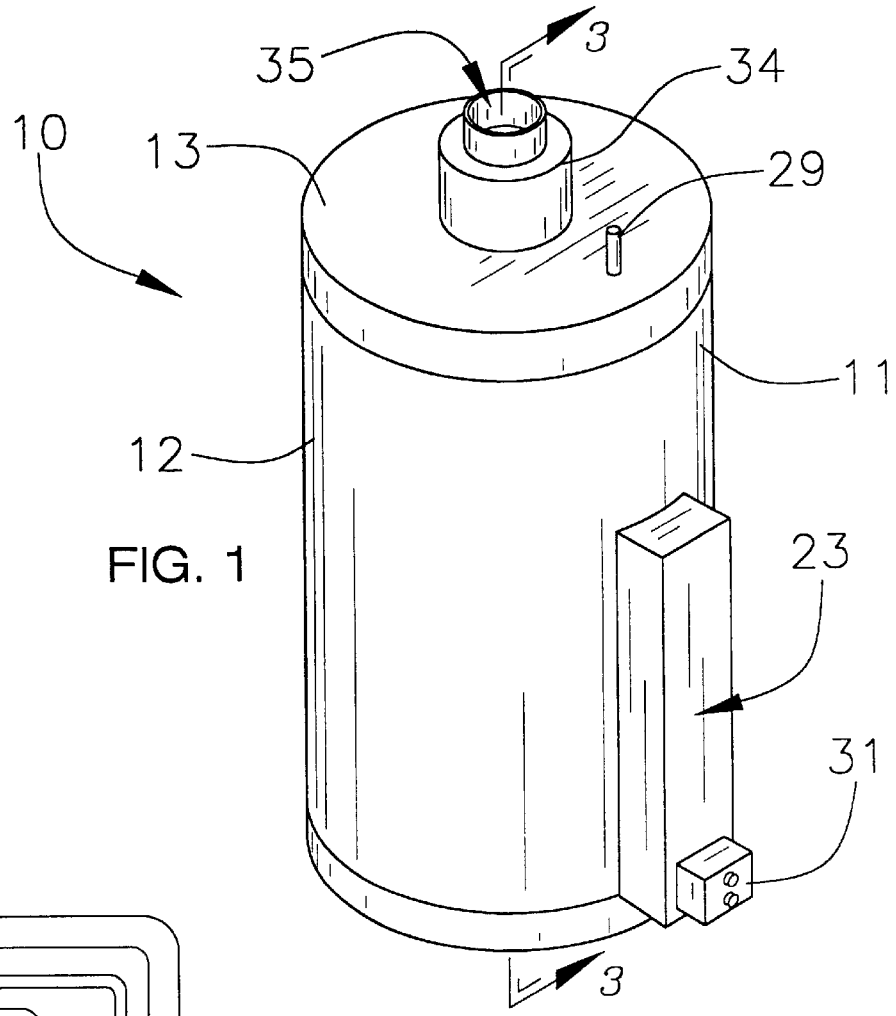
FIG. 1 is a perspective view of a new water heater apparatus according to the present invention.
Figure 2:
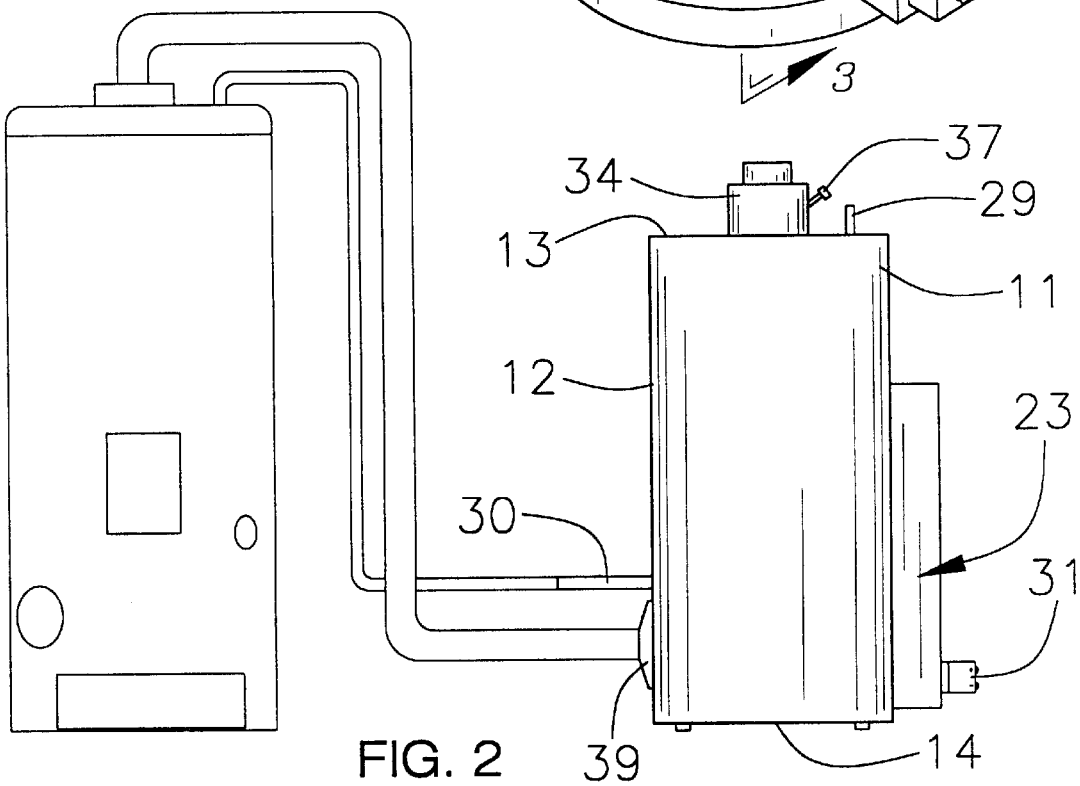
FIG. 2 is a side elevational view of the present invention.
Figure 3:
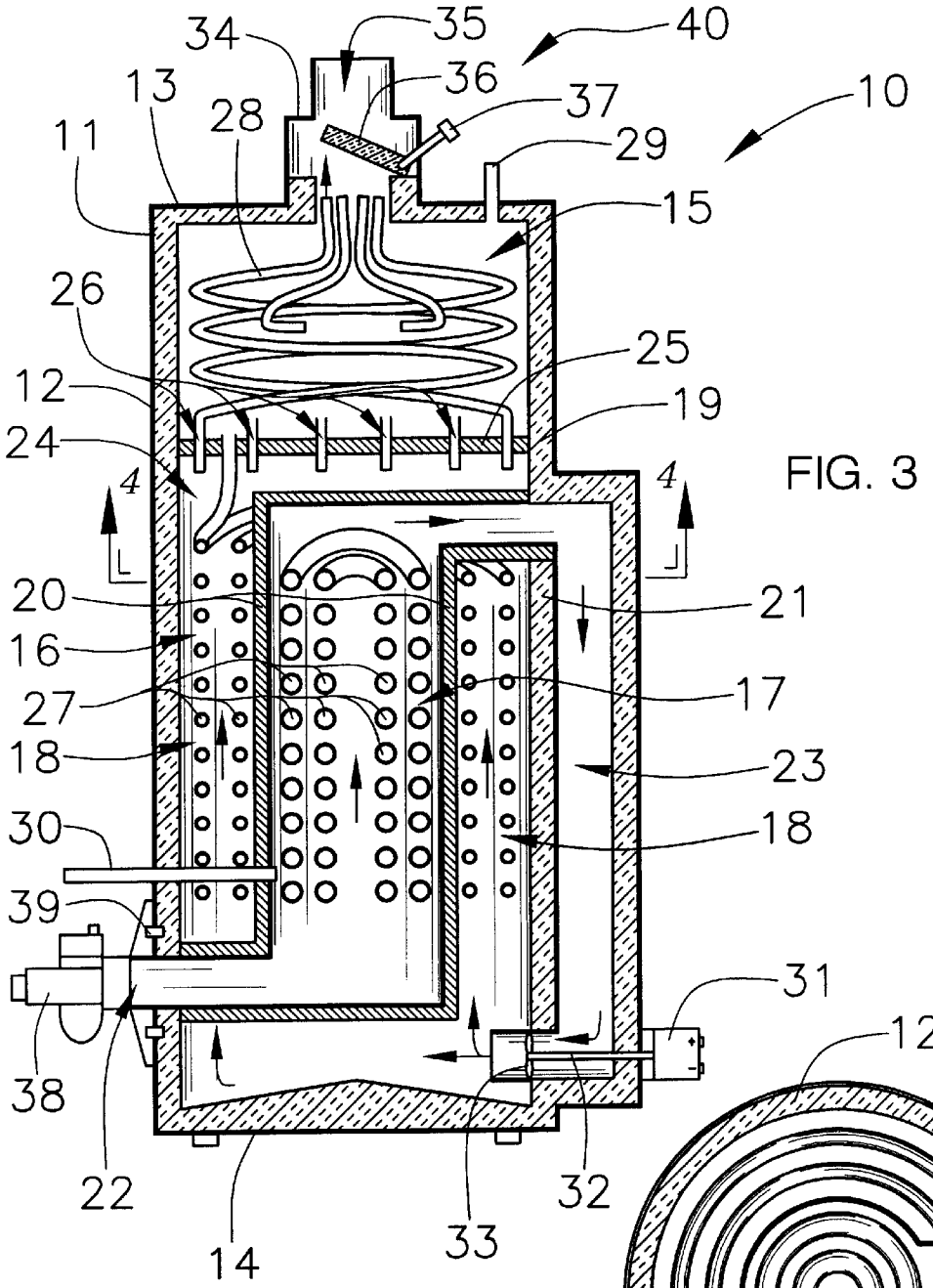
FIG. 3 is a longitudinal cross-sectional view of the present invention.
Figure 4:
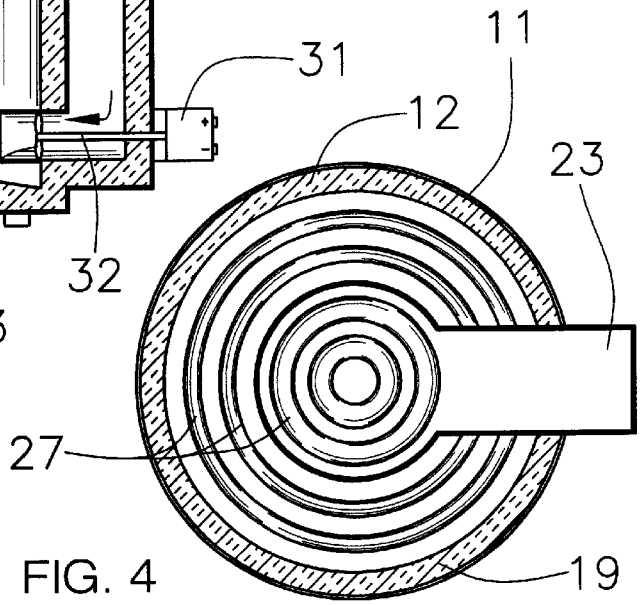
FIG. 4 is a lateral cross-sectional view of the present invention.

With reference now to the drawings, and in particular to FIGS. 1 through 4 thereof, a new water heater apparatus embodying the principles and concepts of the present invention and generally designated by the reference numeral 10 will be described.

As best illustrated in FIGS. 1 through 4, the water heater apparatus 10 generally comprises a tank 11 having top 13, bottom 14, and side walls 12, and also having an upper portion 15 and a lower portion 16, and further having a plurality of heat transferring chambers 17,18 and ducts 22–24 being conventionally disposed inside thereof. The heat transferring chambers 17,18 include an inner chamber 17 and an outer chamber 18 being separated from the inner chamber with an inner wall structure 20. The upper portion 15 is separated from the lower portion 16 with a partition 25 having a plurality of ports 26 disposed therethrough. The ducts 22–24 include an inlet duct 22 being conventionally disposed through the side wall 12 of the tank 11 near the bottom wall 14 thereof and also being conventionally disposed through a bottom of the inner wall structure 20 and into the inner chamber 17, and also include a chamber-interconnecting duct 23 being conventionally disposed through a top of the inner wall structure 20 and extending along an outer wall 21 of the outer chamber 18 and through a bottom of the outer wall 21 and into the outer chamber 18, and further includes an outlet duct 24 interconnecting the upper portion 15 to the lower portion 16 of the tank 11. The inner wall structure 20 is made of brick, and the top, bottom and side walls 12–14 of the tank 11 have a thickness with insulating material 19 being disposed therein.

A plurality of pipes 27–30 are conventionally disposed in the tank 11. The pipes 27–30 are disposed in the chambers 17,18 and in the upper portion 15 of the tank 11. The pipes 27–30 include coiled water pipes 27 being horizontally disposed and vertically spaced in the chambers 17,18 of the lower portion 16 of the tank 11, and further include exhaust pipes 28 being conventionally disposed in the upper portion 15 of the tank 11 and being connected to the outlet duct 24, and also include a water outlet pipe 30 extending into the tank 11 through the side wall 12 thereof, and further includes a water inlet pipe 29 extending into the tank 11 through the top wall 13 thereof.

A heat circulating assembly 40 is conventionally connected to the tank 11 for circulating water through the chambers 17,18. The heat circulating assembly includes a motor 31 being conventionally mounted to the tank 11, and also includes a shaft 32 being rotatably attached to the motor 31 and being disposed in a lower portion of the chamber-interconnecting duct 23, and further includes a fan member 33 being conventionally mounted to the shaft 32 for circulating heat through the chambers 17,18, and also including a flue 34 being conventionally disposed in and through the top wall 13 of the tank 11 for allowing exhaust to escape the tank 11 through the exhaust pipes 28, and further includes a damper assembly being pivotally and conventionally attached in the flue 34 for opening and closing a passageway 35 through the flue 34. The damper assembly includes a damper member 36 and a counterweight member 37 being conventionally attached to the damper member 36 for biasedly closing the damper member 36 in the passageway 35 of the flue 34.

A heating assembly is conventionally connected to the tank 11 for heating water inside the tank 11. The heating assembly includes a burner unit 38 being conventionally mounted to the tank 11 and being conventionally connected to the inlet duct 22, and also includes a burner door 39 being conventionally mounted upon the tank 11 and being adapted to close the inlet duct 22.

In use, water is fed into the tank 11 through the water inlet pipe 29 and is circulated through the coiled water pipes 27 with the water begin heated with hot air being heated by the burner unit 38 and with the hot air being circulated by the fan member 33 through the chambers 17,18 about the coiled water pipes 27. The hot water is then transported out of the tank 11 through the water outlet pipe 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A water heater apparatus comprising:

a tank having top, bottom, and side walls, and also having an upper portion and a lower portion, and further having a plurality of heat transferring chambers and ducts being disposed inside thereof;

a plurality of pipes being disposed in said tank;

a heat circulating assembly being connected to said tank for circulating water through said chambers; and a heating assembly being connected to said tank for heating water inside said tank;

wherein said heat transferring chambers include an inner chamber and an outer chamber being separated from said inner chamber with an inner wall structure, said upper portion being separated from said lower portion with a partition having a plurality of ports disposed therethrough;

wherein said ducts include an inlet duct being disposed through said side wall of said tank near said bottom wall thereof and also being disposed through a bottom of said inner wall structure and into said inner chamber, and also include a chamber-interconnecting duct being disposed through a top of said inner wall structure and extending along an outer wall of said outer chamber and through a bottom of said outer wall and into said outer chamber, and further include an outlet duct interconnecting said upper portion to said lower portion of said tank.

2. A water heater apparatus as described in claim 1, wherein said inner wall structure is made of brick, and said top, bottom and side walls of said tank has a thickness with insulating material being disposed therein.

3. A water heater apparatus as described in claim 1, wherein said pipes are disposed in said chambers and in said upper portion of said tank, said pipes including coiled water pipes being horizontally disposed and vertically spaced in said chambers of said lower portion of said tank, and further including exhaust pipes being disposed in said upper portion of said tank and being connected to said outlet duct, and also including a water outlet pipe extending into said tank through said side wall thereof, and further including a water inlet pipe extending into said tank through said top wall thereof.

4. A water heater apparatus as described in claim 1, wherein said heating assembly includes a burner unit being mounted to said tank and being connected to said inlet duct, and also includes a burner door being mounted upon said tank and being adapted to close said inlet duct.

5. A water heater apparatus as described in claim 1, wherein said heat circulating assembly includes a motor being mounted to said tank, and also includes a shaft being rotatably attached to said motor and being disposed in a lower portion of said chamber-interconnecting duct, and further includes a fan member being mounted to said shaft for circulating heat through said chambers, and also includes a flue being disposed in and through said top wall of said tank for allowing exhaust to escape said tank through said exhaust pipe, and further includes a damper assembly being pivotally attached in said flue for opening and closing a passageway through said flue, said damper assembly including a damper member and a counterweight member being attached to said damper member for biasedly closing said damper member in said passageway of said flue.

6. A water heater apparatus comprising:

a tank having top, bottom, and side walls, and also having an upper portion and a lower portion, and further having a plurality of heat transferring chambers and ducts being disposed inside thereof, said heat transferring chambers including an inner chamber and an outer chamber being separated from said inner chamber with an inner wall structure, said upper portion being separated from said lower portion with a partition having a plurality of ports disposed therethrough, said ducts including an inlet duct being disposed through said side wall of said tank near said bottom wall thereof and also being disposed through a bottom of said inner wall structure and into said inner chamber, and also including a chamber-interconnecting duct being disposed through a top of said inner wall structure and extending along an outer wall of said outer chamber and through a bottom of said outer wall and into said outer chamber, and further including an outlet duct interconnecting said upper portion to said lower portion of said tank, said inner wall structure being made of brick, and said top, bottom and side walls of said tank having a thickness with insulating material being disposed therein;

a plurality of pipes being disposed in said tank, said pipes being disposed in said chambers and in said upper portion of said tank, said pipes including coiled water pipes being horizontally disposed and vertically spaced in said chambers of said lower portion of said tank, and further including exhaust pipes being disposed in said upper portion of said tank and being connected to said outlet duct, and also including a water outlet pipe extending into said tank through said side wall thereof, and further including a water inlet pipe extending into said tank through said top wall thereof;

a heat circulating assembly being connected to said tank for circulating water through said chambers, said heat circulating assembly including a motor being mounted to said tank, and also including a shaft being rotatably attached to said motor and being disposed in a lower portion of said chamber-interconnecting duct, and further including a fan member being mounted to said shaft for circulating heat through said chambers, and also including a flue being disposed in and through said top wall of said tank for allowing exhaust to escape said tank through said exhaust pipe, and further including a damper assembly being pivotally attached in said flue for opening and closing a passageway through said flue, said damper assembly including a damper member and a counterweight member being attached to said damper member for biasedly closing said damper member in said passageway of said flue; and a heating assembly being connected to said tank for heating water inside said tank, said heating assembly including a burner unit being mounted to said tank and being connected to said inlet duct, and also including a burner door being mounted upon said tank and being adapted to close said inlet duct.

7. A water heater apparatus comprising:

a tank having top, bottom, and side walls, said tank having an upper portion and a lower portion, said tank having a plurality of heat transferring chambers and ducts being disposed inside thereof;

a plurality of pipes being disposed in said tank;

a heat circulating assembly being connected to said tank for circulating water through said chambers; and a heating assembly being connected to said tank for heating water inside said tank;

wherein said heat transferring chambers include an inner chamber and an outer chamber being separated from said inner chamber with an inner wall structure, said upper portion being separated from said lower portion with a partition having a plurality of port disposed therethrough;

wherein said ducts include an inlet duct being disposed through said side wall of said tank thereof and being disposed through said inner wall structure and into said inner chamber, a chamber-interconnecting duct being disposed through said inner wall structure and extending along an outer wall of said outer chamber and said outer wall and into said outer chamber, and an outlet duct interconnecting said upper portion to said lower portion of said tank.

8. A water heater apparatus as described in claim 7, wherein said inlet duct is disposed through said side wall near said bottom wall, and said chamber-interconnecting duct is disposed through a top of said inner wall structure and through a bottom of said outer wall.

9. A water heater apparatus as described in claim 7, wherein said inner wall structure is made of brick.

10. A water heater apparatus as described in claim 7, wherein said top, bottom and side walls of said tank each have a thickness with insulating material being disposed therein.

11. A water heater apparatus as described in claim 7, wherein said pipes are disposed in said chambers and in said upper portion of said tank, said pipes including coiled water pipes being substantially horizontally disposed and vertically spaced in said chambers of said lower portion of said tank.

12. A water heater apparatus as described in claim 7, wherein said pipes include exhaust pipes being disposed in said upper portion of said tank and being connected to said outlet duct.

13. A water heater apparatus as described in claim 7, wherein said pipes include a water outlet pipe extending into said tank through said side wall thereof.

14. A water heater apparatus as described in claim 7, wherein said pipes include a water inlet pipe extending into said tank through said top wall thereof.

15. A water heater apparatus as described in claim 7, wherein said heating assembly includes a burner unit being mounted to said tank and being connected to said inlet duct, and also includes a burner door being mounted upon said tank and being adapted to close said inlet duct.

16. A water heater apparatus as described in claim 7, wherein said heat circulating assembly includes:

a motor being mounted to said tank;

a shaft being rotatably attached to said motor and being disposed in said chamber-interconnecting duct;

a fan member being mounted to said shaft for circulating heat through said chambers;

a flue being disposed in and through said top wall of said tank for allowing exhaust to escape said tank through said exhaust pipe;

a damper assembly being pivotally attached in said flue for opening and closing a passageway through said flue, said damper assembly including a damper member and a counterweight member being attached to said damper member for biasedly closing said damper member in said passageway of said flue.

* * * * *